US006206687B1

(12) United States Patent
Redington

(10) Patent No.: US 6,206,687 B1
(45) Date of Patent: Mar. 27, 2001

(54) HIGH TURNDOWN MODULATING GAS BURNER

(75) Inventor: Gordon F. Redington, Maplewood, MN (US)

(73) Assignee: AAF-McQuay Inc., Minneapolis, MN (US)

( * ) Notice: Subject to any disclaimer, the term of this patent is extended or adjusted under 35 U.S.C. 154(b) by 0 days.

(21) Appl. No.: 08/788,017

(22) Filed: Jan. 24, 1997

(51) Int. Cl.[7] ..... F23N 1/02; F23Q 7/06

(52) U.S. Cl. ..... 431/90; 431/89; 431/12; 431/187; 431/266; 431/62; 431/265; 137/625.5; 137/625.48; 251/206

(58) Field of Search ..... 431/8, 12, 10, 431/62, 63, 187, 264, 265, 266, 89, 90; 236/15 BD; 137/625.48, 625.5, 625.12, 625.13; 251/205, 206

(56) References Cited

U.S. PATENT DOCUMENTS 2,626,656 * 1/1953 Wyatt .
2,929,393 * 3/1960 Wallace et al. .
3,384,338 * 5/1968 Dermody .
3,556,700 * 1/1971 Jackson et al. .
4,509,912 * 4/1985 Vanberkum .
4,978,293 12/1990 Ryno .
5,088,916 * 2/1992 Furuhashi et al. .
5,099,085 * 3/1992 Taylor .
5,313,984 * 5/1994 Garwood, Jr. et al. .
5,486,108 * 1/1996 Kubota .

FOREIGN PATENT DOCUMENTS

0234991 * 9/1987 (EP) ..... 321/12
1084543 * 4/1984 (SU) .

* cited by examiner

*Primary Examiner*—Carl D. Price
(74) *Attorney, Agent, or Firm*—Patterson, Thuente, Skaar & Christensen, P.A.

(57) ABSTRACT

A gas burner and method of controlling burning, the gas burner including a controller disposed in a control cabinet, a burner cabinet, an actuator and a blower, the blower being fluidly coupled to the burner cabinet. The gas burner has an air valve that is operably, fluidly coupled to both the burner cabinet and the blower for controlling the flow of air from the blower to the burner cabinet. A gas valve is fluidly coupled to a source of gas for controlling the flow of gas from the source of gas. An actuator is communicatively coupled to the controller and is linearly coupled to the air valve and the gas valve for simultaneous linear actuation thereof responsive to commands from the controller.

37 Claims, 10 Drawing Sheets

HIGH TURNDOWN MODULATING GAS BURNER

TECHNICAL FIELD

The present invention is a gas burner. More particularly, the present invention is a gas burner with a high turndown capability, permitting the burner to operate between less than 5% and 100% of the maximum firing rate.

BACKGROUND OF THE INVENTION

A gas burner is the fire producing device used in a warm air furnace, a heat exchanger, a boiler, an oven, and the like. Typically, the gas burner controls the flow rate and mixing of air and gas and includes the controls that do the ignition and safety monitoring of the flame. For many applications of a gas burner, the amount of heat required is not constant. The amount of heat required may vary according to the weather, the process load, and other conditions. To deal with varying loads, banks of multiple burners have been used. The banks of multiple burners may be sequenced to produce the required amount of heat. Alternatively, a burner with a variable firing rate may also be used. A burner with a variable firing rate can be a staged burner, capable of operating either at a low fire or high fire, or it can be a modulating burner. A modulating burner is capable of being controlled to operate at any firing rate within a range between its minimum and maximum firing rates. That range is typically 50%–100%, with some of the better burners being capable of 33%–100%. That means that when the heat requirement is less than the minimum firing rate of the burner, 33% in the case of the better burners, the only alternative is to periodically cycle the burner on and off at the minimum rate in order to produce a lesser amount of heat than is produced at the minimum rate. Unfortunately, this results in fluctuating temperatures and therefore less than ideal control when operating in this mode.

Accurate and consistent temperature control is improved if a burner is capable of operating at a very low minimum firing rate. A great deal of effort in the industry has been expended toward achieving the goal of having a very low minimum firing rate. Typically, efforts at providing such capability have concentrated on control of the gas flow and control of the secondary air.

With respect to control of the gas flow, the maximum fire rate of a gas burner is typically controlled by the sizing of the main gas orifice. The size is typically set when the burner is manufactured and is invariable thereafter. The maximum firing rate occurs when a specified gas pressure is present at the fixed orifice. To effect the minimum firing rate on a modulating gas burner, it is common practice to control a butterfly gas valve or other similar device to cause a reduction in the gas pressure to the fixed orifice. Reducing the gas pressure causes a reduction in the gas flow rate through the fixed orifice, thereby reducing the firing rate of the burner. Typically, a control actuator is mechanically linked to the butterfly gas valve to also control a combustion air damper, such that both the gas and the combustion air are simultaneously reduced to achieve the minimum firing rate. Alternatively, the combustion air damper only is controlled. Such control reduces the air pressure within the burner. A suitable pressure regulator is then used to sense the reduced air pressure and to control the gas pressure proportionately.

Because the flow rate to a fixed orifice varies as the square of the pressure across it, there are practical limits as to how low the flow can be reduced using either of the foregoing techniques. As an example, if the burner utilizes 4.0 inches water column orifice pressure at the maximum firing rate, the pressure would have to be reduced to unmanageably low levels to operate in the region below approximately 20% of the maximum firing rate. Such levels are indicated in Table 1 below.

| | |
|---|---|
| 100% | 4.00 In. W.C. |
| 50% | 1.00 In. W.C. |
| 33% | .44 In. W.C. |
| 20% | .16 In. W.C. |
| 10% | .04 In. W.C. |
| 5% | .01 In. W.C. |

As indicated above, secondary air may be also controlled to achieve a minimum firing rate. Secondary air is that air which is introduced directly into the combustion zone. Typically the combustion air to a modulating gas burner is controlled by a pivoting damper blade. A pivoting damper blade is inadequate for a burner that is going to be modulated down to a minimum firing rate that is less than 25% of the maximum firing rate. A pivoting damper blade simply does not allow precise enough control near and at the desired minimum firing rate.

On gas burners that control secondary air to proportion combustion air, primary air is not presently varied in any fashion in order to affect the minimum and maximum burning rates. Primary air is that air that is mixed directly with the gas stream before it enters the combustion zone. Having a source of primary air is common practice with many types of gas burners.

As previously indicated, there is a need in the industry for a gas burner that is capable of operating efficiently at very low minimum firing rate. Such firing rate should be in the range of less than 25% of the maximum firing rate. In order to achieve such a low minimum firing rate, a new means of accurate and consistent temperature control is required.

SUMMARY OF THE INVENTION

The present invention substantially meets the aforementioned needs of the industry. The apparatus of the present invention maintains a relatively constant pressure on the gas flow orifice but varies the area of the orifice. This is accomplished by having a square orifice and controlling the open area of the orifice by positioning a tapered plug at various positions within the orifice. Generally, the valve will have a specific stroke length for the tapered plug and the taper of the tapered plug will be defined for a particular capacity profile along that stroke. Accordingly, valves sized for lower capacity will have less taper and therefore there will be less open area at the maximum capacity position. Although a square orifice has been described, the present invention may also utilize round or other shaped orifices with an appropriate shaped plug. Additionally, the profile of the tapered plug can be characterized so that a specific flow rate will occur at specific stroke positions. In this manner, the plug can have a linear rate of change or with a compound face of the taper the plug can have a slow rate of increase at the minimum firing rate end of the stroke and a fast rate of increase toward the maximum firing rate end the stroke.

The gas burner of the present invention meters secondary air using a sliding blade under a plate that had characterized openings responsive to the need of the burner from the minimum firing rate to the maximum firing rate. Accordingly, the apertures admitting the secondary air can be precisely determined along the stroke of the blade.

The aforementioned sliding blade also controls air to a port that supplies the primary air to the burner. Preferably, at the minimum firing rate, a specific amount of primary air is mixed with the gas. As the amount of gas increases when a higher firing rate is commanded, the amount of primary air is also increased. When the firing rate increases beyond a certain point, the primary air is cut off. At this point, the primary air is not needed for good combustion and the addition of the primary air needlessly adds to the gas port pressure drop in the burner gun.

For the gas burner of the present invention, a new source of air is utilized to enhance the combustion of the gas. At very low firing rates, good combustion requires that the combustion air be greatly reduced and that the flame receives that air at the correct location relative to the gas. Toward this end, a source of base air is supplied directly into the burner gun assembly. The base air and the gas are mixed proximate the point at which the gas emerges from the burner gun.

A further advantage of the present invention is that both the sliding blade of the air valve and the wedge of the gas valve are linearly actuated. Accordingly, they can be directly connected to a single linearly actuated rod, thus eliminating the need for crank arms, adjustable linkage, and the like typically employed in present gas burners to coordinate an air damper and a gas valve linked together.

The present invention is a gas burner and method of controlling burning, the gas burner including a controller disposed in a control cabinet, a burner cabinet, an actuator and a blower, the blower being fluidly coupled to the burner cabinet. The gas burner has an air valve that is operably, fluidly coupled to both the burner cabinet and the blower for controlling the flow of air from the blower to the burner cabinet. A gas valve is fluidly coupled to a source of gas for controlling the flow of gas from the source of gas. An actuator is communicatively coupled to the controller and is linearly coupled to the air valve and the gas valve for simultaneous linear actuation thereof responsive to commands from the controller.

DETAILED DESCRIPTION OF THE PREFERRED EMBODIMENT

Figure 1:
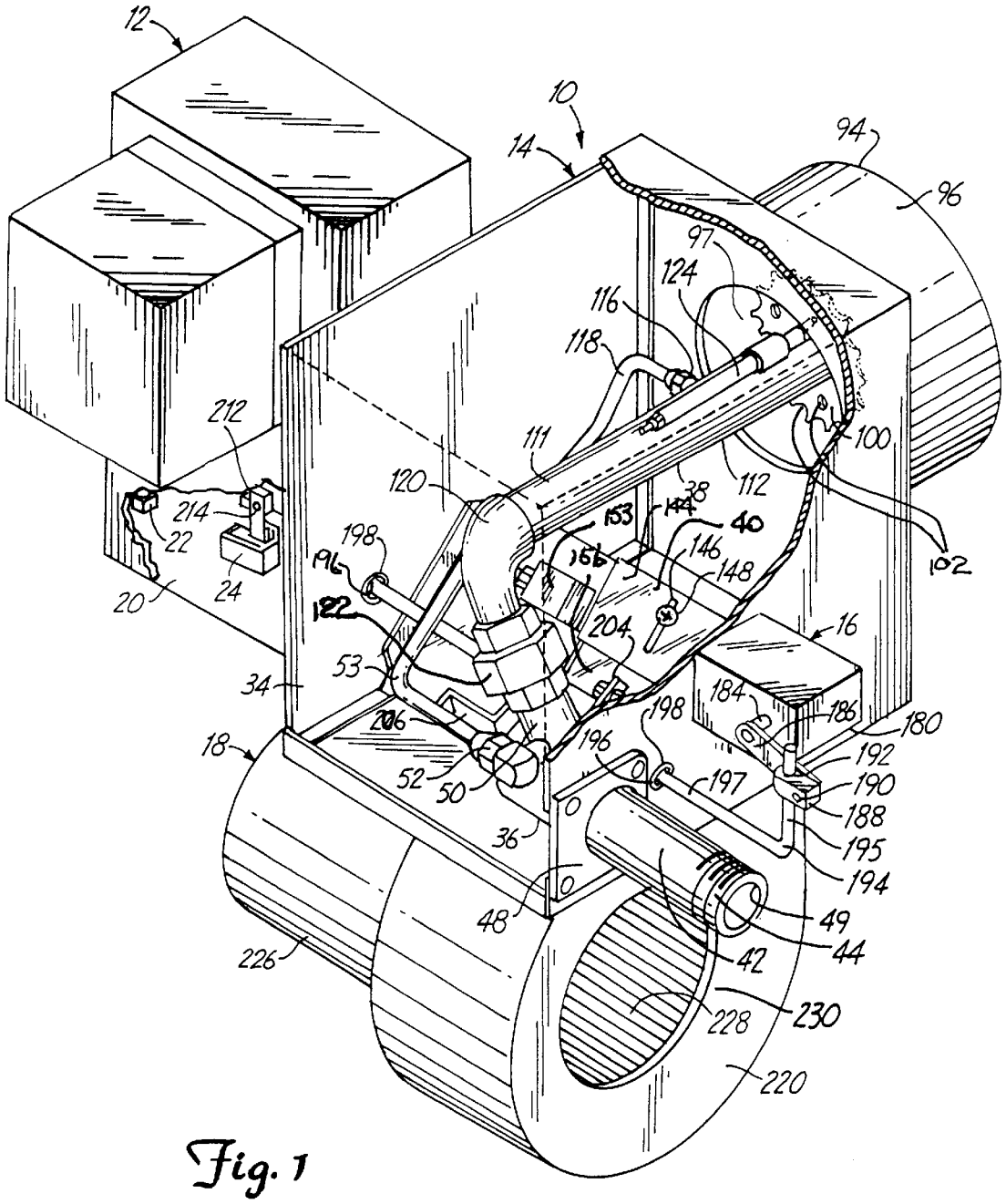
FIG. 1 is a perspective view of the gas burner of the present invention with portions of the burner cabinet broken away.
Figure 2:
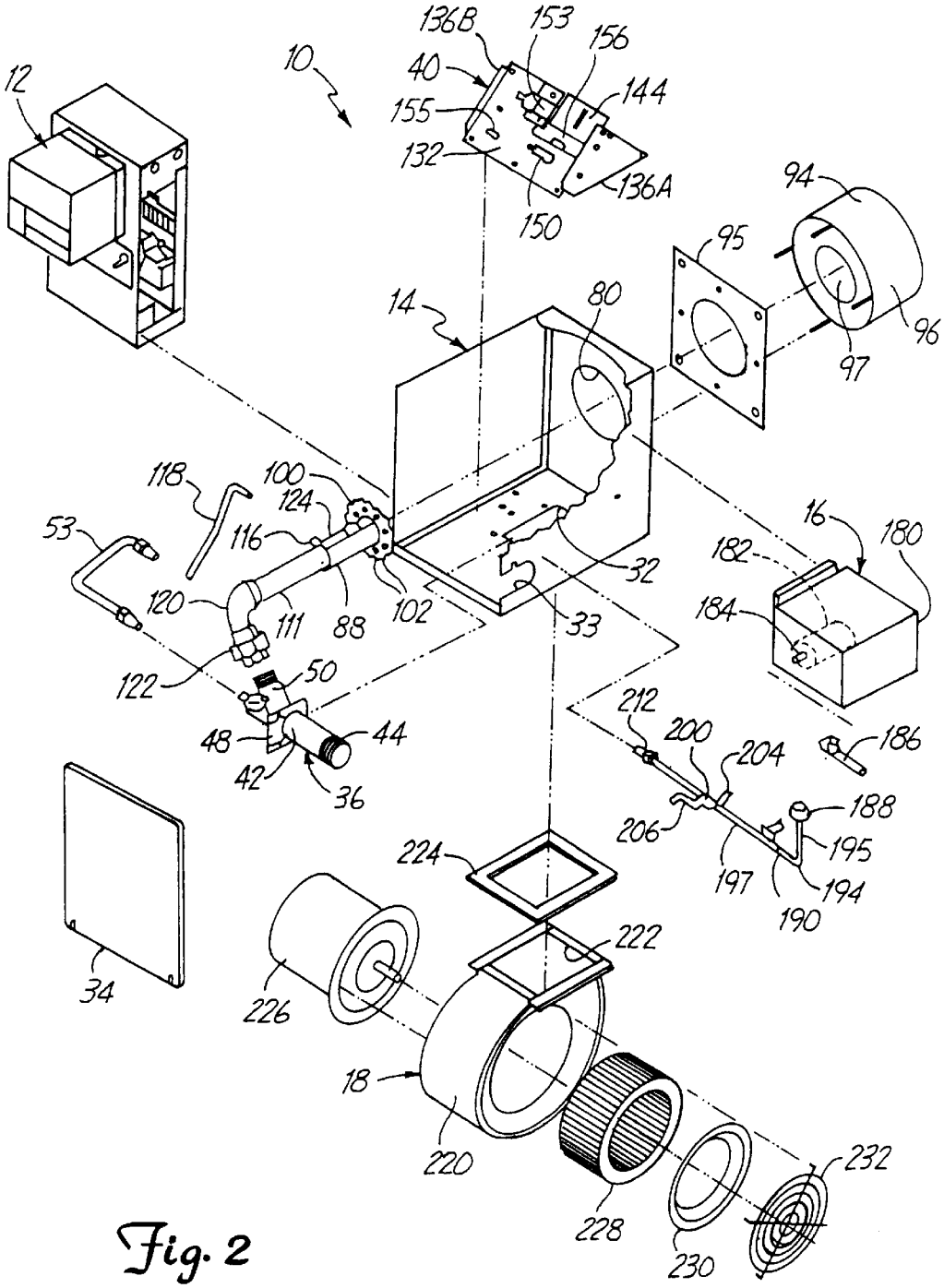
FIG. 2 is an exploded perspective view of the gas burner of the present invention.

The gas burner of the present invention is shown generally at 10 in FIGS. 1 and 2. Gas burner 10 has four major components: control cabinet 12, burner cabinet 14, control actuator 16, and blower 18.

Figure 16:
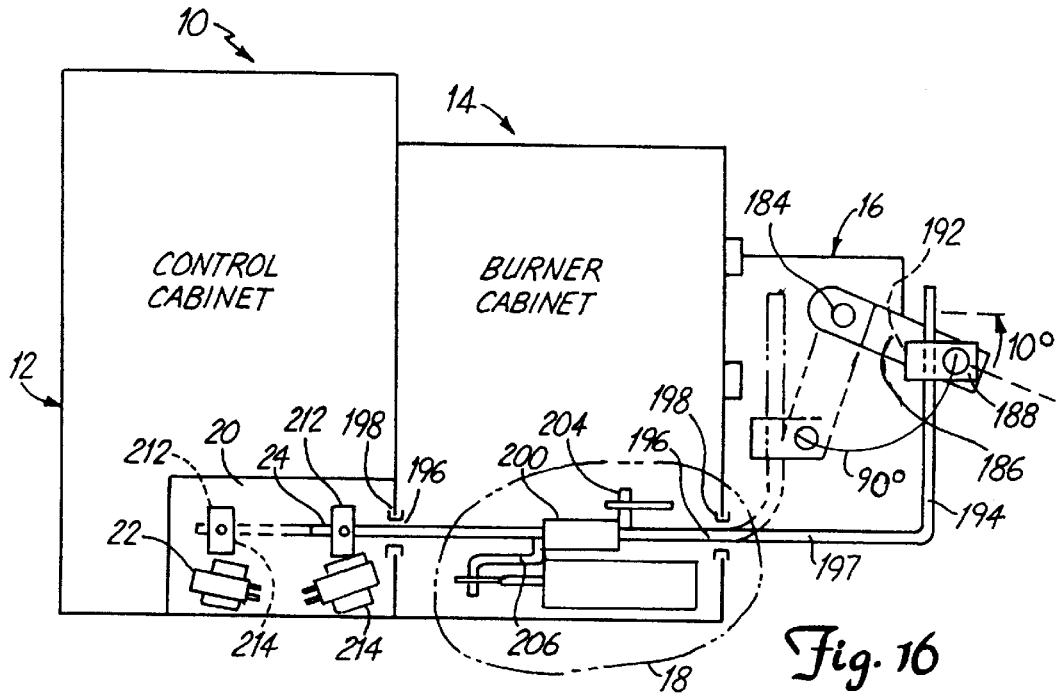
FIG. 16 is a front elevational view of the actuator of the gas burner.
Figure 18:
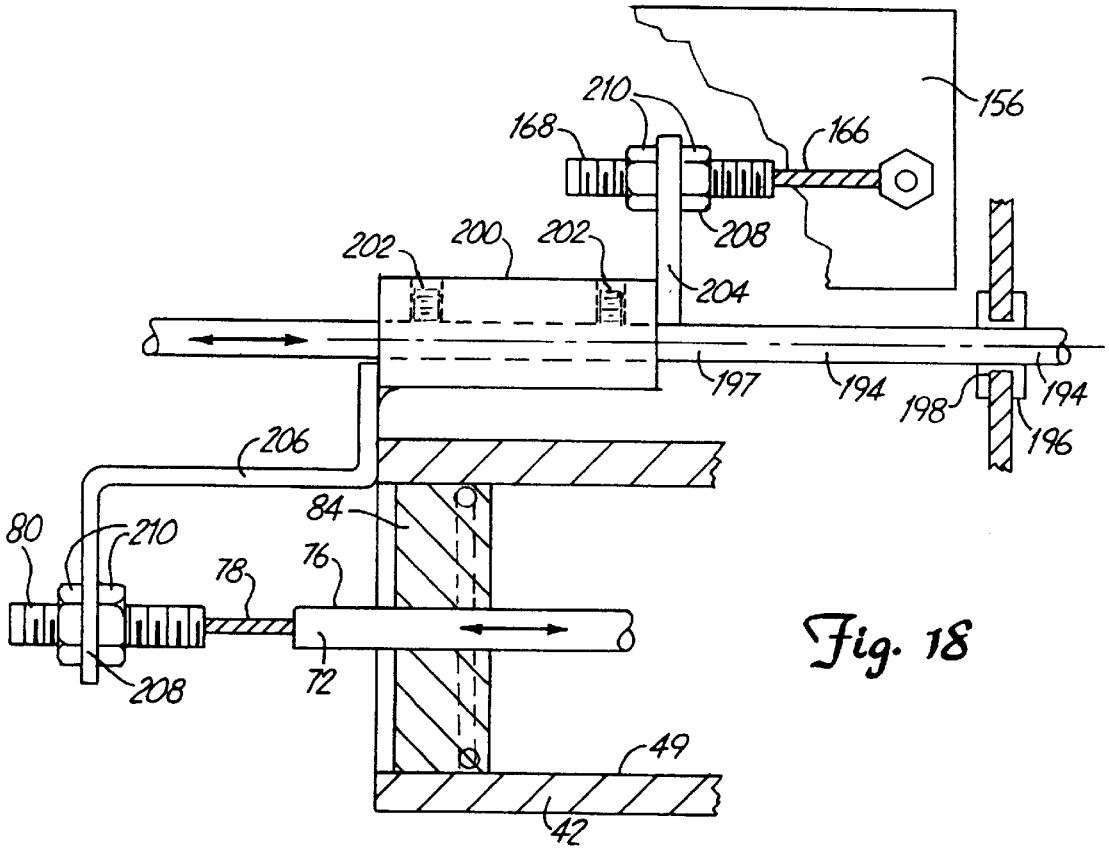
FIG. 18 is an enlarged front elevational view of the actuator coupled to the air valve and the gas valve taken at oval 18 of FIG. 17.
Figure 17:
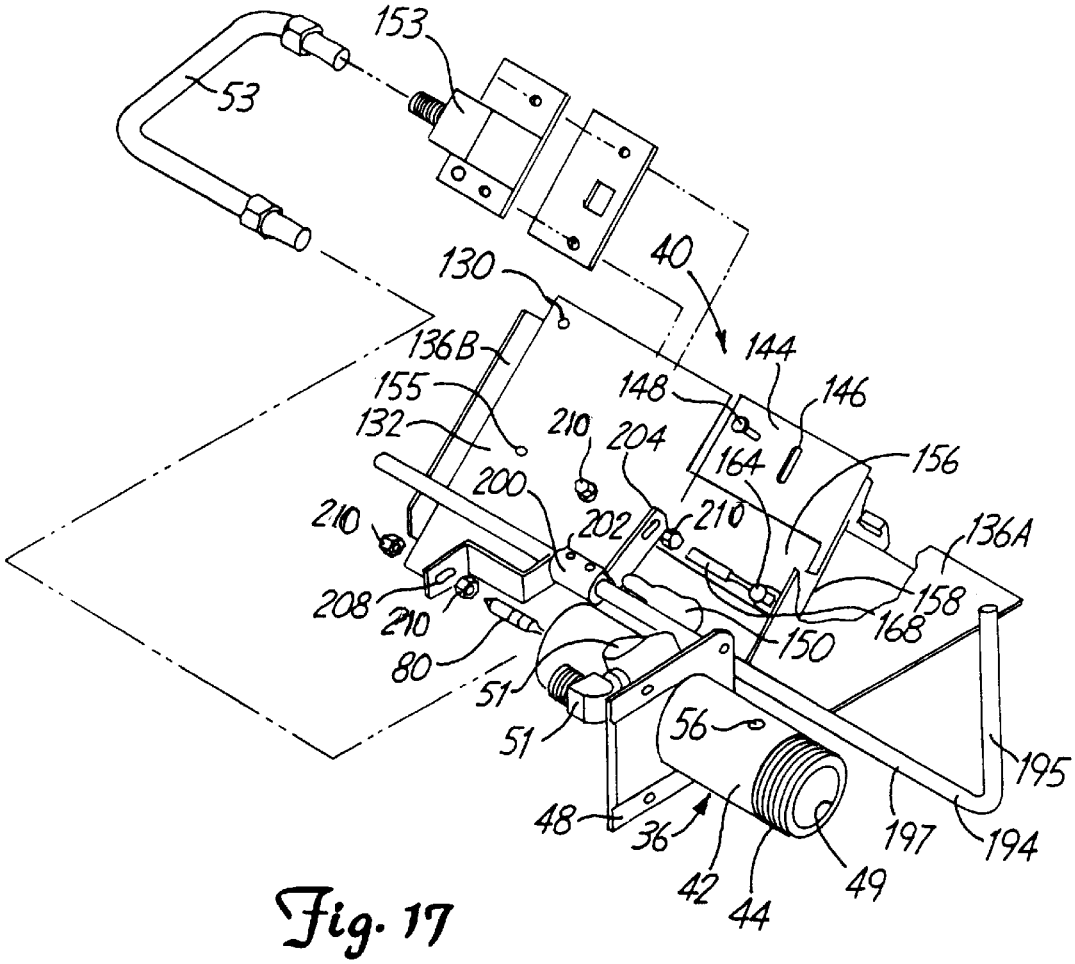
FIG. 17 is a perspective, exploded view of the actuator arm coupled to the air valve and the gas valve.

The control cabinet 12 contains timers, relays and wiring necessary to control the gas burner 10. At the lower portion of the control cabinet 12 is a switch compartment 20. A pair of interlock switches, the maximum fire switch 22 and the minimum fire switch 24, are spaced apart within the switch compartment 20 and are utilized to control the prepurge of the furnace combustion chamber prior to ignition of the gas burner 10. The interlock switches 22, 24 are also depicted in FIG. 16.

The burner cabinet 14 is generally parallelepiped shaped and has a burner gun aperture 30 and air inlet 32, and a gas valve aperture 33. A face cover 34 is positioned in place on the burner cabinet 14 during burner operations to make the burner cabinet 14 generally air tight. The burner cabinet 14 has three major components therein; gas valve 36, burner gun 38, and air valve 40.

The gas valve 36 of the burner cabinet 14 is depicted in FIGS. 1 through 7*b*. The gas valve 36 has a generally cylindrical housing 42. A first end of the cylindrical housing 42 has threads 44 cut therein. The threads 44 facilitate fluidly coupling the gas valve 36 to a pipe having a source of gas under pressure. A mounting plate 48 is fixedly coupled to the cylindrical housing 42 in a substantially orthogonal relationship to the center line of the cylindrical housing 42. Mounting plate 48 is designed to fixedly couple the gas valve 36 to the side of the burner cabinet 14. The cylindrical housing 42 has a gas flow passageway 49 defined therein.

A gas-air outlet 50 is fixedly coupled to the cylindrical housing 42. The gas-air outlet 50 is preferably disposed at an acute included angle with respect to the cylindrical housing 42. A gas-air passageway 51 is defined within the gas-air outlet 50. The gas-air passageway 51 is in flow communication with the gas flow passageway 49. A primary air inlet 52 is fixedly coupled to the gas-air outlet 50. The primary air inlet 52 is fluidly coupled to the gas-air passageway 51 defined in the gas-air air outlet 50 for the mixing of primary air and gas therein. The primary air inlet 52 is fluidly coupled to the air valve 40 by a primary air tube 53.

An orifice plate 54 is disposed within the gas flow passageway 49 at a point approximately midway along the cylindrical housing 42. Preferably, the orifice plate 54 is held in place be a press fit. A pressure tap 56 is formed in the cylindrical housing 42 upstream of the orifice plate 54. An orifice 58 is defined in the orifice plate 54. In the preferred embodiment, the orifice 58 is rectangular in shape. Other shapes, such as a circular or oval opening, could also be used for the orifice 58. A tapered plug 60 is translatably disposed within the orifice 58. The shape of the tapered plug 60 is designed to match that of the orifice 58. Accordingly, the tapered plug 60 has a rectangular cross-section for use with a rectangular orifice 58. The tapered plug 60 has a circular cross-section for use with a circular orifice 58. In the preferred embodiment, tapered plug 60 has an upwardly directed tapered face 62.

Figure 7B:
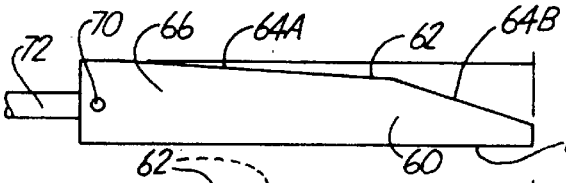
FIG. 7*b* is a side elevational view of a further alternative embodiment of the tapered plug.
Figure 7A:
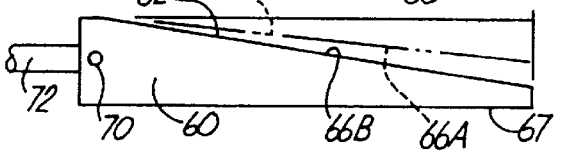
FIG. 7*a* is a side elevational view of an alternative embodiment of the tapered plug.

As indicated in FIGS. 7*a* and 7*b*, the slope of the tapered face 62 can be adjusted to accommodate greater or lesser gas flow rates required of the particular usage of the gas burner 10. As depicted in FIG. 7*a*, the tapered face 62 having a taper indicated at 66A is utilized for a lower capacity gas valve 36, while the taper indicated at 66B is utilized for a relatively higher capacity gas valve 36.

As indicated in FIG. 7*b*, the slope of the tapered face 62 can be compounded having a first slope 64*a* for use at relatively low burn rates and a great slope 64*b* for use as the gas burner 10 approaches its maximum burn rate. In translation, the tapered plug 60 is supported by its lower surface 67 riding on the lower margin 65 of the orifice 58.

Figure 3:
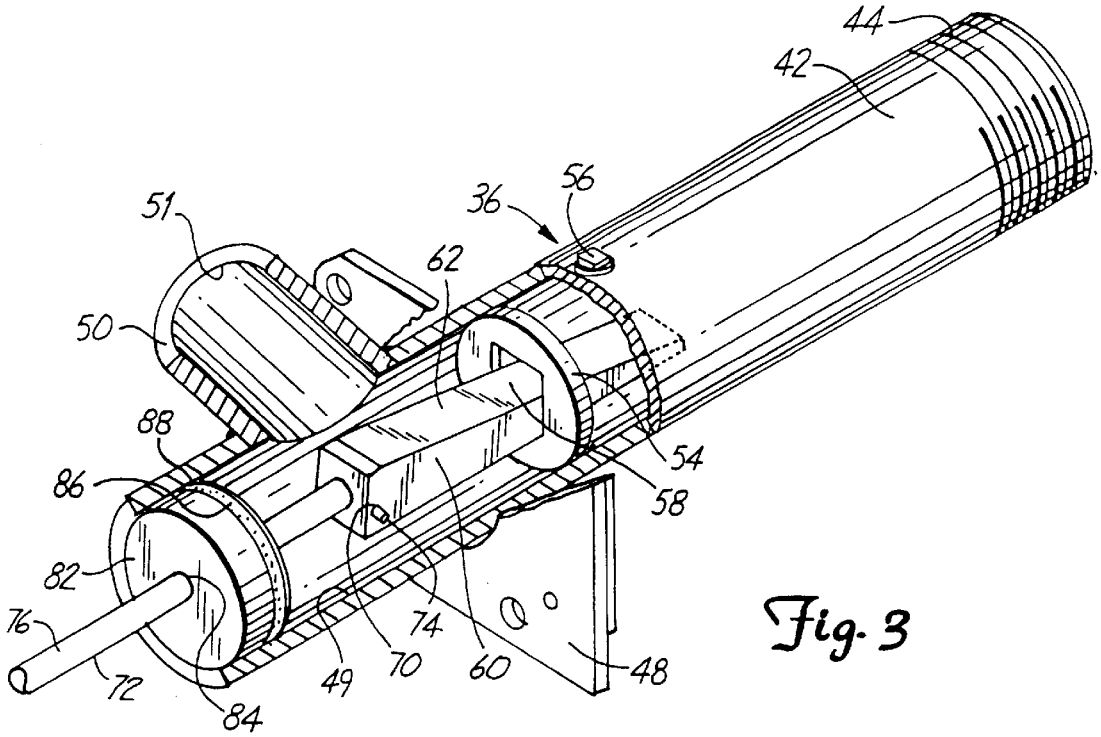
FIG. 3 is a sectional perspective view of the gas valve of the gas burner.
Figure 4:
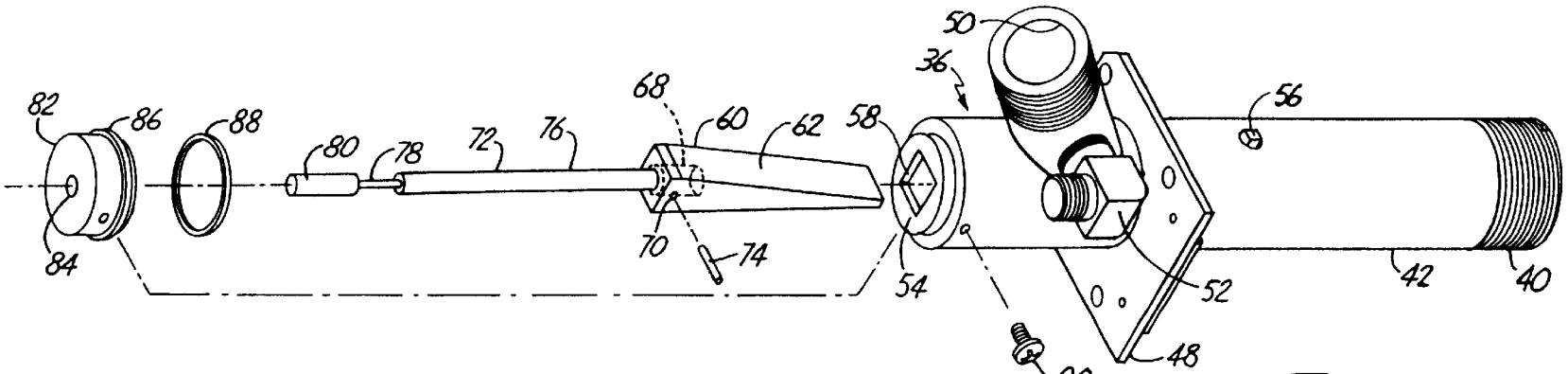
FIG. 4 is an exploded perspective view of the gas valve of the gas burner.
Figure 5:
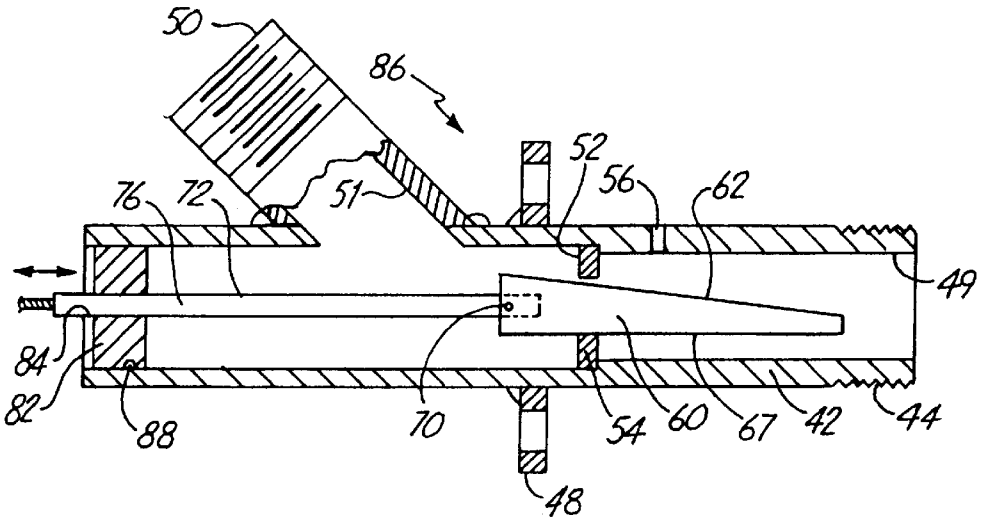
FIG. 5 is a sectional side view of the gas valve of the gas burner.
Figure 6:
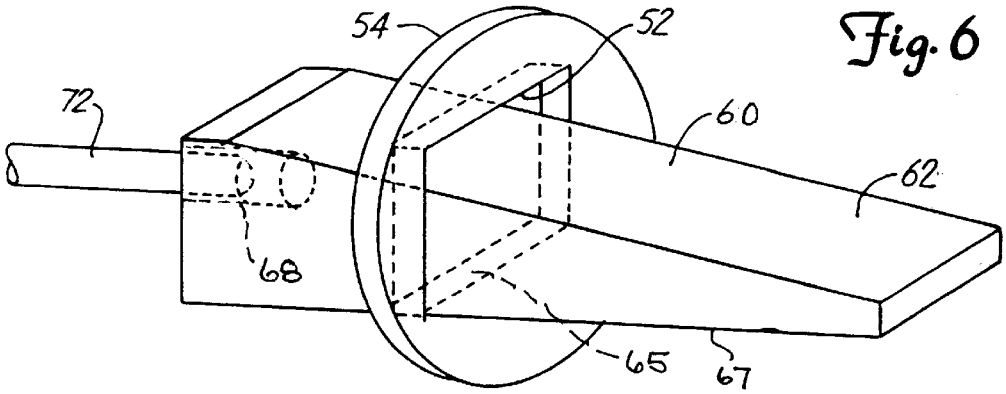
FIG. 6 is a perspective view of the tapered plug and the orifice of the gas valve.

Referring to FIGS. 3, 4 and 6, an actuator bore 68 is defined in an end of the tapered plug 60. A cross-bore 70 intersects the actuator bore 68. An end of an actuator rod 72 is disposed within actuator bore 68 and coupled thereto by pin 74 passing through the cross-bore 70 and a bore (not shown) defined in the actuator rod 72 that is in registry with the cross-bore 70.

The actuator rod 72 preferably has a first inflexible segment 76 and a second flexible segment 78. The inflexible segment 76 is preferably made of a slender metallic rod. The flexible segment 78 is preferably made of a twisted metallic cable. A threaded connector 80 is fixedly coupled to an end of the flexible segment 78.

A generally circular bearing 82 is inserted into an end of the cylindrical housing 42. The bearing 82 is preferably formed of a plastic material having a very low coefficient of friction. The bearing 82 has a bearing bore 84 defined therein. The bearing bore 84 has a slightly greater inside diameter than the outside diameter of the inflexible segment 76 of the actuator rod 72, such that the actuator rod 72 is freely translatable within the bearing bore 84.

An O-ring groove 86 is defined circumferential to the bearing 82. An O-ring 88 is disposed within the O-ring groove 86. The bearing 82 is preferably pressed into the cylindrical housing 42 with the O-ring 88 providing a gas-air seal. The bearing 82 is retained in position by set screw 90.

Turning now to the burner gun 38 as depicted in FIGS. 1 and 2, and 8–10, a blast tube 94 is mounted to the rear wall of the burner cabinet 14 with a gasket 95 interposed therebetween. When the gas burner 10 is mounted to a furnace or the like, the blast tube 94 projects to the combustion chamber of the furnace he innermost projection of the blast tube 94 is typically mounted flush with the wall of the combustion chamber of the furnace. The blast tube 94 has an outer wall 96 and an inner wall 97, with a cast refractory material 99 deposited therebetween.

Figure 9:
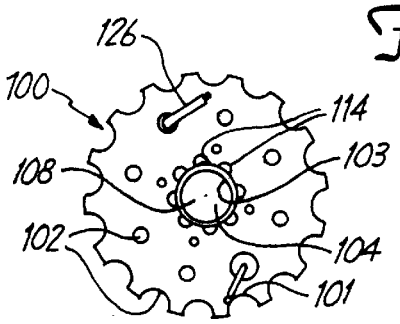
FIG. 9 is an elevational end view of the burner gun of the gas burner.
Figure 10:
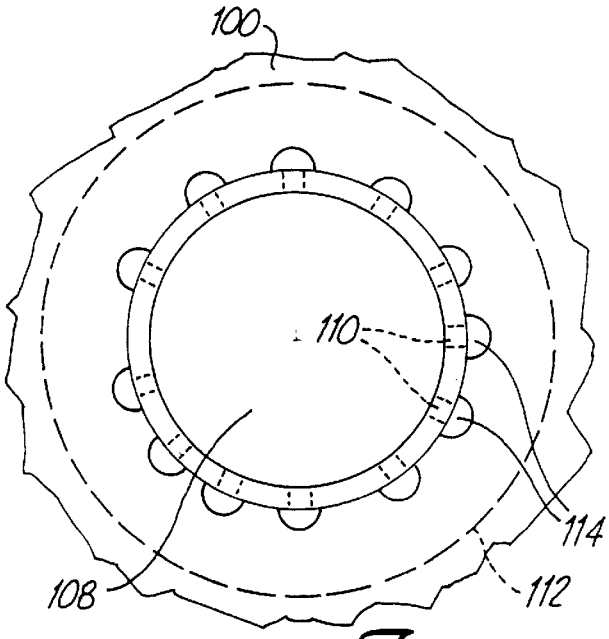
FIG. 10 is an elevational end view of the center portion of the burner plate and the burner gun of the gas burner.
Figure 10A:
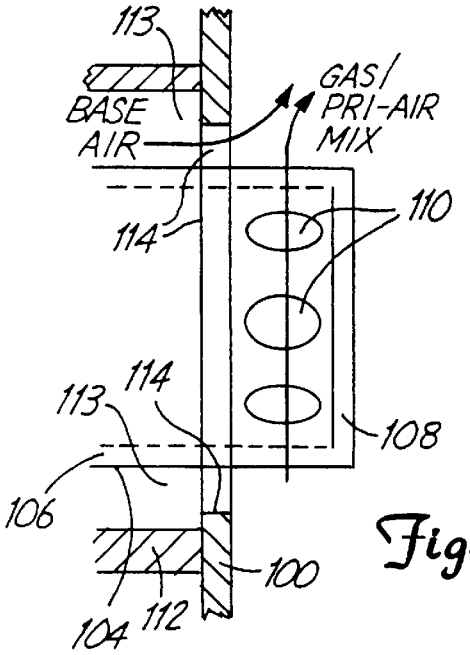
FIG. 10*a* is side sectional view of the burner plate and burner gun of FIG. 10.

The burner gun 38 has a generally circular burner plate 100, as depicted in FIGS. 1, 9 and 10. The diameter of the burner plate 100 is slightly smaller than the inside diameter of the inner wall 97 of the blast tube 94 such that the burner plate 100 may be disposed within the inner wall 97.

The burner plate 100 has a plurality of secondary air orifices 102 defined therein. Some of the secondary orifices 102 are defined peripheral to the burner plate 100, while other secondary air orifices 102 are defined in the mid-region of the burner plate 100. A nozzle bore 103 is defined at the very center of the burner plate 100. A nozzle 104 is disposed within the nozzle bore 103 and is fixedly joined to the burner plate 100. The nozzle 104 has a central axis that is disposed generally orthogonal to the plane of the burner plate 100.

Figure 8:
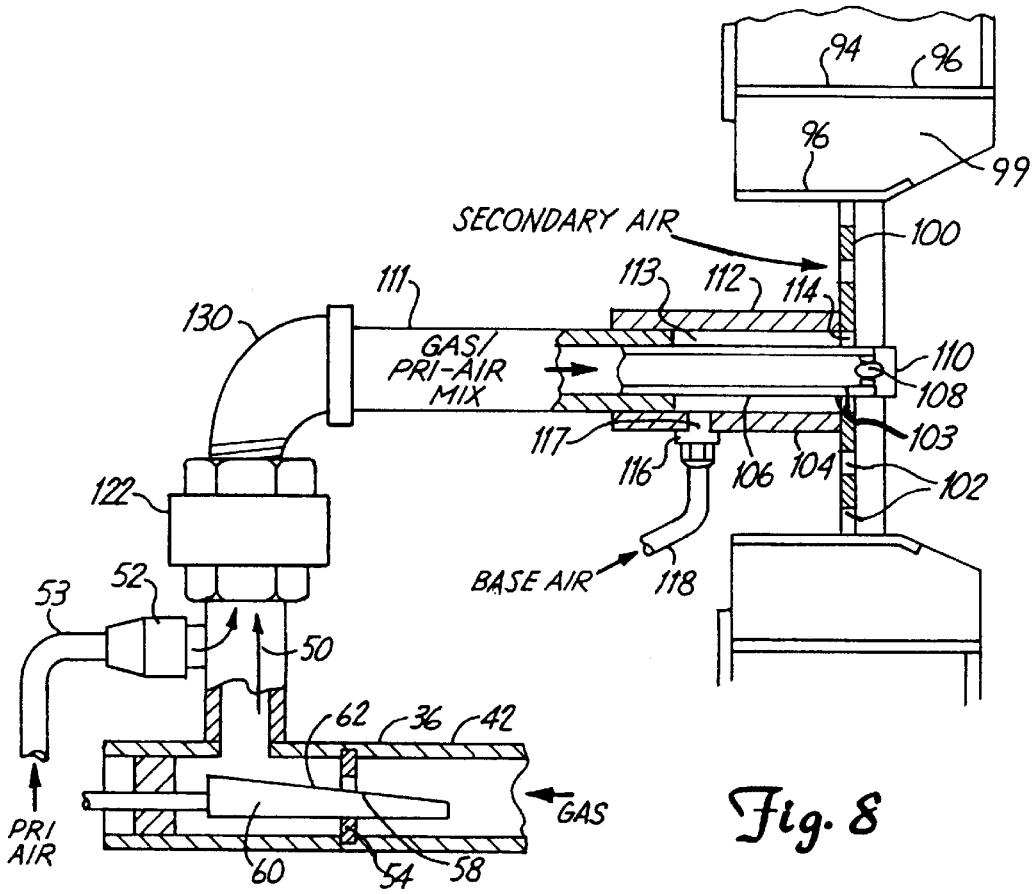
FIG. 8 is a sectional side view of the burner gun of the gas burner.

Referring to FIG. 8, the nozzle 104 has a tubular body 106. An end plate 108 caps the distal end of the tubular body 106. A plurality of radial orifices 110 are defined in the tubular body 106 proximate the end plate 108. The proximal end of the tubular body 106 is fixedly coupled to the inside diameter of a gas-air pipe 111.

A base air shroud 112 is disposed circumferential to and spaced apart from the nozzle 104. A circumferential base air passageway 113 is defined between the base air shroud 112 and the tubular body 106 of the nozzle 104. A first end of the base air shroud 112 is fixedly joined to the burner plate 100 and a second end of the base air shroud 112 is fixedly joined at the outside diameter of the gas-air pipe 111. A plurality of base air orifices 114 are defined in the burner plate 100 and are fluidly coupled to the base air passageway 113. Preferably, a base air orifice 114 is disposed adjacent to each of the radial orifices 110 of the nozzle 104.

A base air inlet 116 is defined in the wall of the base air shroud 112. The base air inlet 116 is fluidly coupled to the base air passageway 113 and to a base air tube 118. The base air tube 118 is fluidly coupled to the air valve 40 for receiving air under pressure therefrom. An orifice 117 is defined in the base air inlet 116 to control the amount of base needed for the particular application of the gas burner 10 and is typically increased in size for the higher output applications. In an application, the orifice 117 may be a sixteenth of an inch in diameter.

The gas air pipe 111 is fluidly coupled to an elbow 120 and a union 122 to the gas-air outlet 50 of the gas valve 36. A flame rod 124 is mounted on the burner gun 38. The sensor tip 126 of the flame rod 124 projects through a bore defined in the burner plate 100 to sense the presence of a flame.

The third component of the burner cabinet 14 is the air valve 40. The air valve 40 is depicted in FIGS. 1 and 2 and 11–15. The air valve 40 is fixedly, sealingly coupled to the floor of the burner cabinet 14, overlying the air inlet 32 defined therein.

Figure 11:
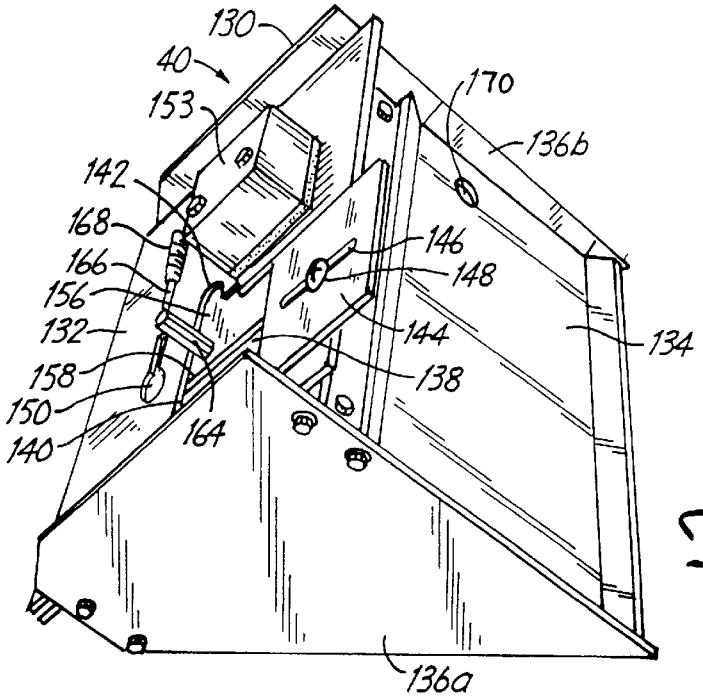
FIG. 11 is a perspective view air valve of the gas burner with portions of the air valve broken away.
Figure 12:
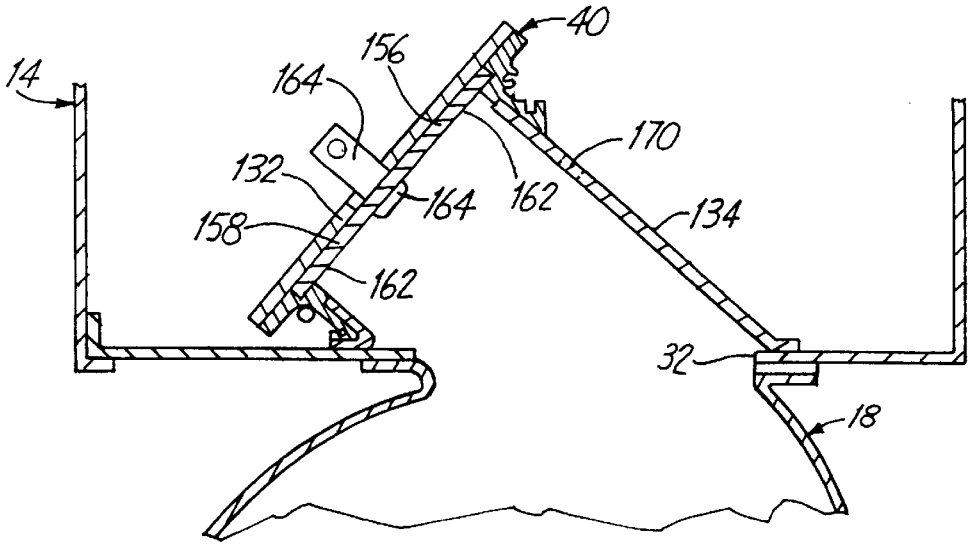
FIG. 12 is a sectional side view of the air valve of the gas burner.
Figure 13:
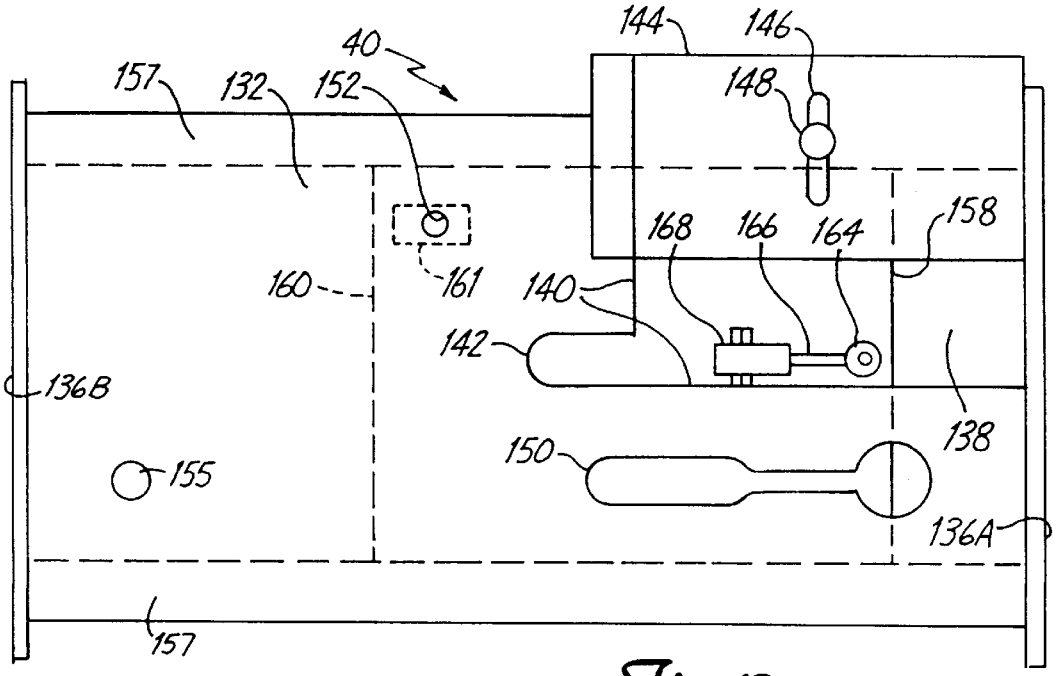
FIG. 13 is a elevational front view of the profile plate and sliding plate of the air valve.

The air valve 40 has an air box enclosure 130 having a generally triangular cross-section, as seen in FIGS. 11 and 12. The air box enclosure 130 has a front profile plate 132 and a back plate 134. The profile plate 132 and the back plate 134 are joined at the upper margins thereof and sealed by the two opposed end plates 136*a*, 136*b*.

Referring to the profile plate 132, a secondary air aperture 138 is defined in the profile plate 132, fluidly coupling the space defined within the air box enclosure 130 and the space defined within the burner cabinet 14. Secondary air aperture 138 is defined by the aperture margin 140 of the profile plate 132 in cooperation with the end plate 136*a*. A connector slot 142 is preferably defined in a corner of the aperture margin 140.

A moveable restrictor plate 144 is positioned over a portion of the secondary air aperture 138. The restrictor plate 144 is positionable relative to the secondary air aperture 138 by an elongated slot 146 defined therein and a set screw 148 threaded into the profile plate 132.

A second secondary air aperture, termed a characterized aperture 150, is defined in the profile plate 132. The shape of the characterized aperture 150 is preferably unique to the specific application that the gas burner 10 is to be used in.

A primary air aperture 152 is defined in the profile plate 132. The primary air aperture 152 is fluidly coupled to a primary air housing 153. The primary air housing 153 is fixedly, sealingly coupled to the profile plate 132. The primary air housing 153 is threadably coupled to the primary air tube 53.

A third secondary air aperture, termed the secondary air bore 155, is also defined in the profile plate 132. In the embodiment depicted, the secondary air bore 155 is open for the initial translation of the sliding plate 156 from the minimum fire position and is closed off by the sliding plate 156 as the sliding plate 156 approaches the maximum fire position. Alternatively, the secondary air bore 155 may be formed in the back plate 134. In such a disposition, the secondary air bore 155 is always open between the space defined within the air box enclosure 130 and the space defined in the burner cabinet 14.

The sliding plate 156 is positioned beneath the profile plate 132. The sliding plate 156 is slidably borne in tracks 157. The sliding plate 156 has a leading edge 158 and a trailing edge 160. The leading edge 158 defines the size of the secondary air aperture 138 that is open to the space defined within the air box 130 and defines the portion of the characterized aperture 150 that is open to the space defined within the air box enclosure 130. Similarly, the trailing edge 160 defines when the secondary air bore 155 is open to the space defined within the air box enclosure 130 as a function of the translational position of the sliding plate 156 relative to the profile plate 132.

Referring to FIGS. 14*a*–14*c* and 15, a primary air slot 161, defined in the sliding plate 156, is partially or fully in registry with the primary air aperture 152 or closes off the primary air aperture 152 as a function of the translational position of the sliding plate 156 relative to the profile plate 132.

A bolt 164 couples the sliding plate 156 to a flexible actuator 166. A threaded connector 168 is fixedly coupled to the flexible actuator 166.

The fourth component of the gas burner 10 is the control actuator 16. The control actuator 16 is depicted in FIGS. 1 and 2 and 16–18. The control actuator 16 has an actuator enclosure 180 that is preferably fixedly joined to the burner cabinet 14.

A reversible gear motor 182, comprising a rotary actuator, is disposed within the actuator enclosure 180, as depicted in FIG. 2. An output shaft 184 of the motor 182 projects through the side of the actuator enclosure 180. A rotary actuator arm 186 is fixedly coupled to the output shaft 184. The sliding bearing 188 is rotatably coupled to the rotary actuator arm 186 by a bolt 190. A bearing bore 192 is defined in sliding bearing 188. The sliding bearing 188 is preferably made of a plastic material having a very low coefficient of friction.

A generally L-shaped linear actuator arm 194 has a first arm 195 that is slidably disposed within the bearing bore 192.

The second arm 197 of the linear actuator arm 194 is substantially longer than the first arm 195. The second arm 197 passes through the burner cabinet 14 and terminates in the switch compartment 20 of the control cabinet 12. The second arm 197 is borne in bearings 198 positioned in actuator bores 196 in the two side panels of the burner cabinet 14.

A slidable sleeve 200 is positioned on the second arm 197 within the burner cabinet 14. Sleeve 200 is positioned as desired on the second arm 197 and then set in position by set screws 202.

An air control arm 204 is fixedly adjoined to a first end of the sleeve 200. A gas control arm 206 is fixedly joined to the second end of the sleeve 200. Both the air control arm 204 and the gas control arm 206 have a bore 208 defined therein. The threaded connector 168 that is joined to the sliding plate 156 is positioned within the bore 208 of the air control arm 204 and fixed in place by nuts 210. The threaded connector 80 coupled to the tapered plug 60 of the gas valve 36 is positioned in the bore 208 defined in the gas control arm 206 and fixed in place by nuts 210. In this manner, translation of the second arm 197 of the linear actuator arm 194 simultaneously linearly controls both the gas valve 36 and the air valve 40.

A switch actuator 212 is disposed proximate the distal end of second arm 197 and held in position by a set screw 214. The switch actuator 212 is designed to make the maximum fire switch 22 when the linear actuator arm 194 is in the maximum fire position and to make the minimum fire switch 24 when the linear actuator arm 194 is in the minimum fire position. FIG. 1 depicts the gas burner 10 in the minimum fire position.

The blower 18 of the gas burner 10 is depicted in FIGS. 1, 2, and 12. Blower 18 has a helical housing 220 having a discharge port 222. When the blower 18 is mated to the underside of the burner cabinet 14, the discharge port 222 is in registry with the air inlet 32 of the burner cabinet 14. A gasket 224 is positioned between the helical housing 220 and the surface of the burner cabinet 14.

An electric blower motor 226 is positioned on a first side of the helical housing 220. The blower motor 226 is rotatably coupled to a rotor 228. An inlet cone 230 and grill 232 are positioned on the opposite side of the helical housing 220 from the blower motor 226.

The gas burner 10 of the present invention has a control system housed within the control cabinet 12. The control system uses a microprocessor flame safeguard control. A typical sequence of operation commences with the control system calling for burner operation. Prior to ignition of the gas burner 10, a pre-purge operation is performed. The pre-purge period is necessary to clear the combustion chamber of the furnace and the burner cabinet 14 of any combustibles that may have accumulated there since the last operation of the gas burner 10. It should be noted that no gas flow in the gas valve 36 occurs during the pre-purge period. Prior to initiation of the timed pre-purge period, the control system sends a signal to the control actuator 16 commanding the maximum fire position and also initiates operation of the blower 18. As indicated in FIG. 16, the rotary actuator arm 186 preferably rotates through an arc of 90° commencing at a minimum fire position that is approximately 10% below a level position.

Responsive to the command from the control system, the bi-directional rotary stepper motor 182 energizes and rotates the rotary actuator arm 186 from the minimum fire position to the maximum fire position. Such rotation causes the sliding bearing 188 to slide downward on the first arm 195 of the linear actuator arm 194 at the same time that the linear actuator arm 194 is moved to the left as depicted in FIG. 16. When the rotary actuator arm 186 has rotated through 90°, the linear actuator arm 194 is in the position depicted in phantom in FIG. 16, which is the maximum fire position. The stroke of the linear actuator arm 194 is preferably 3.5 inches or 4.5 inches, depending on the application of the gas burner 10. The stroke may be any selected length.

Linear translation of the linear actuator arm 194 through the full stroke length from the minimum fire position to the maximum fire position simultaneously fully opens the gas valve 36, fully opens the air valve 40, unmakes the minimum fire switch 24, and makes the maximum fire switch 22. The stroke length of the tapered plug 60, the stroke length of the sliding plate 156, and the distance between the minimum fire switch 24 and the maximum fire switch 22 are substantially equal to the stroke of the linear actuator arm 194. Thus, the tapered plug 60, the sliding plate 156 and the distance between making the two interlock switches 22, 24 all have the same linear stroke length between the respective minimum fire and maximum fire positions.

In the maximum fire position, the sliding plate 156 of the air valve 40 is in its full open position. Secondary air under pressure is flooding the burner cabinet 14 and base air under pressure is being provided to the burner gun 38.

Air flow from the blower 18 is sensed by a pressure switch (not shown) with the air valve 40 in the full open position is indicated to the control system by the making of the maximum fire switch 22 and with air pressure sensed indicating that blower 18 is in operation, the timed pre-purge period is commenced by the control system. This operating condition continues for a selected timed period, preferably approximately twenty seconds.

At the conclusion of the above timed period, the control system sends a command to the control actuator 16 to return to the minimum fire position. Responsive thereto, the control actuator 16 rotates the rotary actuator arm 186 back to the minimum fire position as indicated in FIG. 16. Such rotation causes the linear actuator arm 194 to translate to the right. When the linear actuator arm 194 reaches the minimum fire position, the profile plate 132 of the air valve 40 is in closed position. A small amount of secondary air is provided to the burner cabinet 14 through the secondary air bore 155. Also, the translation of the linear actuator arm 194 to the right causes the switch actuator 212 to make the minimum fire switch 24 when the minimum fire position is reached. Making of the minimum fire switch 24 indicates to the control system that the gas burner 10 is in the minimum fire position. Approximately ten seconds after the minimum fire switch 24 is made, the pre-purge period concludes and the gas burner 10 is ready for ignition.

Figure 14D:
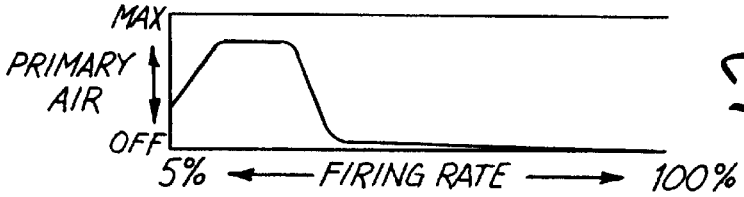
FIG. 14*d* is a diagrammatic of the flow of primary air as indicated in FIGS. 14*a*–14*c*.
Figure 14A:
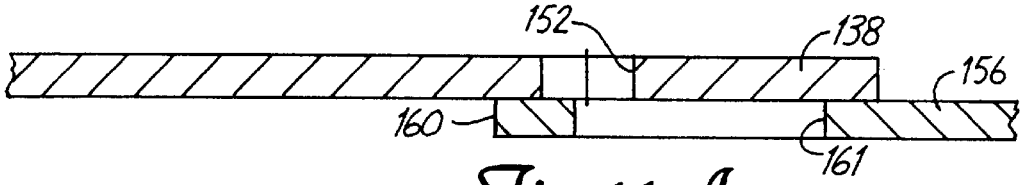
FIG. 14*a* is front sectional view of the primary air aperture at the minimum fire position.
Figure 14B:
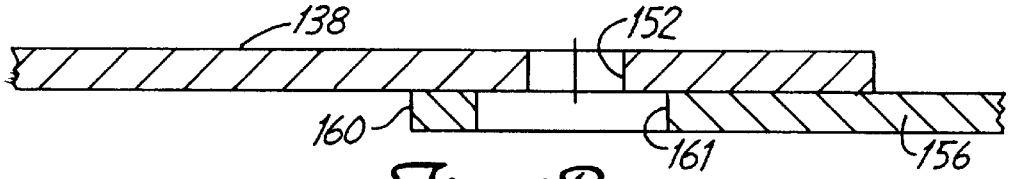
FIG. 14*b* is front sectional view of the primary air aperture at the maximum flow position.
Figure 15:
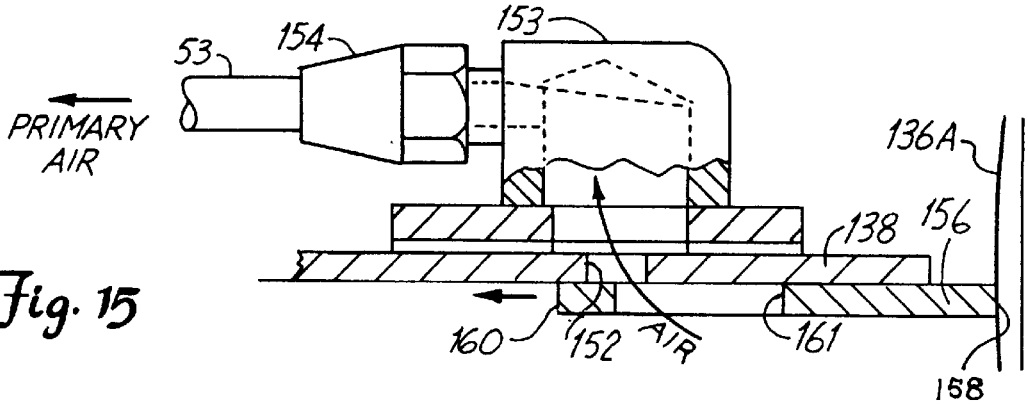
FIG. 15 is front sectional view of the primary air aperture.

In the minimum fire position, with the blower 18 in operation, pressurized secondary air is being provided to the burner cabinet 14 via the secondary air bore 155. Additionally, base air is passing through the base air aperture 170 of the air valve 40 to the base air passageway 113 of the burner gun 38. Further, as indicated in FIGS. 14*a* and 15, an initial quantity of primary air is passing through the primary air aperture 152 of the air valve 40 through the primary air inlet 52 of the gas valve 36 and thence to the nozzle 104 of the burner gun 38. No gas is at this point being provided to the gas burner 10. When the control system completes the pre-purge cycle and receives the signal from the minimum fire switch 24 indicating that the gas burner is in the minimum fire position, the control system opens a gas valve (not shown) permitting gas to flow into the gas flow passageway 49 defined in the gas valve 36. Simultaneously, spark ignition is provided by spark igniter 101 at the face of the burner plate 100 to ignite the gas-air mixture. The minimum fire position corresponds to a fire rate that is 5% or less than the maximum firing rate of the gas burner 10.

The gas-air being combusted at the minimum burn position is a mixture of gas passing around the tapered plug 60 at the orifice 58 combined with the minimum amount of primary air as indicated in FIGS. 14*a* and 15. The gas and primary air are discharged via the radial orifices 110 defined in the nozzle 104 into the blast tube 94 to be consumed in the combustion chamber of the furnace. As the gas-primary air mixture emerges from the radial orifices 110, the mixture is combined with the base air emerging from the base air orifices 114.

A flame safeguard sensor 124 is positioned proximate the interior face of the burner plate 100. After spark ignition at spark igniter 101 is energized, a short trial period for ignition occurs. If the flame safeguard sensor 124 does not detect flame at the end of the trial period, the flame safeguard sensor 124 provides a signal to the control system. The control system goes into safety lockout and must be manually reset before an attempt at burner ignition will occur. If the flame safeguard detects ignition, a signal is sent to the control system and the gas burner 10 will continue to operate as long as the control system requires it and as long as the flame safeguard sensor 124 is detecting flame.

At this point, the control system may command a higher burn rate for the gas burner 10. Such command is sent to the control actuator 16 which causes the rotary actuator arm 186 to rotate out of the minimum fire position toward the maximum fire position. Such rotation causes the linear actuator arm 194 to translate to the left as depicted in FIG. 16. This translation simultaneously causes a number of events to occur. The first such event is the switch actuator 212 unmakes the minimum fire switch 22. The tapered plug 60 is partially withdrawn from the orifice 58. This increases the area in the orifice 58 that is open to the passage of gas. Accordingly, an increased volume of gas flows to the burner gun 38. The increased volume of gas flow requires an increased volume of airflow as well. Accordingly, the sliding plate 156 of the air valve 40 also translates to the left. Such translation does not affect the flow of secondary flow out of the secondary air bore 155 and does not affect the flow of base air out of the base air aperture 170.

Figure 14C:
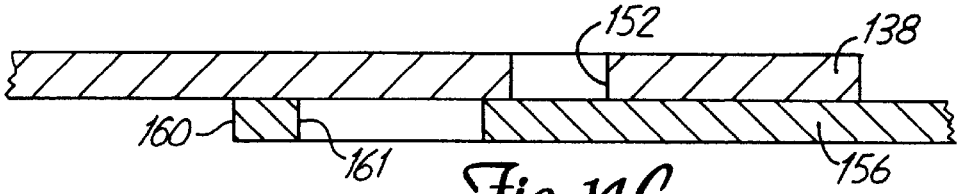
FIG. 14*c* is front sectional view of the primary air aperture at the off position.

Translation of the sliding plate 156 progressively opens the secondary air aperture 138. Additionally, the characterized aperture 150 is also progressively opened. Secondary air then flows through the secondary air aperture 138 and through the characterized aperture 150 to flood the interior of the burner cabinet 14 and to flow into the furnace for combustion via the secondary air orifices 102 defined in the burner plate 100. Simultaneously, the volume of primary air is increased as indicated in the schedule depicted in FIG. 14*d*. As the sliding plate 156 continues to the left, the primary air is increased. When the firing rate increases beyond a certain point as indicated in FIGS. 14*c* and 14*d*, the primary air is cut off. Primary air is not needed beyond the cut off point for good combustion and the primary air needlessly adds to the pressure drop at the radial orifices 110 defined in the nozzle 104.

As commanded by the control system, the linear actuator arm 194 may continue to the left to the maximum fire position. In the maximum fire position, the switch actuator 212 on the linear actuator arm 194 makes the maximum fire switch 22, however, the signal from the maximum fire switch is used only during the pre-purge operation. Additionally, the tapered plug 60 has been withdrawn from the orifice 58 to the maximum extent possible, thereby opening the area for the passage of gas through the orifice 58 to the maximum, creating the maximum area of the orifice 58 for the flow of gas. The air valve 40 is also in its full open position. In such position, primary air is cut off, the base air is flowing, the secondary air aperture 138 and the characterized aperture 150 are fully open, admitting the maximum amount of secondary air into the burner cabinet 14.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principal of the invention, to the full extent indicated by the broad general meaning of the terms in which the appended claims are expressed.

I claim:

1. An air valve for use with a gas burner, comprising:

a profile plate having at least one secondary air aperture defined therein and a primary air aperture defined therein;

a linearly slidable plate disposed with respect to the profile plate such that linear translation thereof acts to vary the area of the primary and secondary air apertures; and a restrictor plate variable positionable with respect to the at least one secondary air aperture to selectively vary the area of the at least one secondary air aperture.

2. A gas valve for use with a gas burner, comprising:

a housing having a longitudinal axis and being fluidly coupled at a gas inlet to a source of gas, and having the gas passageway defined therein;

an orifice disposed in a gas flow passageway, an orifice plate having the orifice defined therein and being disposed in the gas passageway of the housing, between the gas inlet and the fluid outlet;

a linearly translatable plug disposed in the orifice being translatable within the orifice along a translation axis, having a tapered dimension extending along the translation axis, whereby linear translation of the plug along the translation axis acts to vary the area of the orifice available for the passage of gas therethrough; and a fluid inlet fluidly coupled to the gas passageway between the orifice plate and the fluid outlet, the fluid inlet being coupled to a source of fluid for introducing the fluid to the air passageway and mixing the gas flowing therein.

3. The gas burner of claim 2 wherein the translation axis of the translatable plug being disposed generally parallel to the housing longitudinal axis, and further including a bearing being disposed in the housing and slidably supporting an actuator, the actuator being operably coupled to the translatable plug.

4. A burner gun for use with a gas burner, comprising:

a nozzle having a fluid inlet and a plurality of fluid outlets, the nozzle being generally tubular having a longitudinal axis, having a nozzle first end fluidly coupled to a source of fluid and the plurality of nozzle outlets being disposed proximate a nozzle second end, the nozzle outlets being disposed radially with respect to the nozzle longitudinal axis base air delivery means having an air inlet and a plurality of air outlets, each one with said plurality of air outlets being disposed in a cooperative relationship with a corresponding one of said plurality of nozzle fluid outlets whereby a flow of air discharged from each of said plurality of air outlets mixes with a flow of fluid discharged from the corresponding one of said plurality of nozzle fluid outlets;

a shroud disposed concentric with the nozzle and spaced apart from the nozzle to define a base air passageway between the shroud and the nozzle, the base air passageway being fluidly coupled to the plurality of air outlets, an air inlet being defined in the shroud and fluidly coupled to the base air passageway.

5. An air valve for use with a gas burner, the air valve being linearly translatable between a minimum fire position and a maximum fire position, comprising:

a profile plate having at least one secondary air aperture defined therein and a primary air aperture defined therein; and a linearly slidable plate disposed with respect to the profile plate such that linear translation thereof acts to vary the area of the primary and secondary air apertures, the slidable plate substantially closing off the at least one secondary air aperture in the minimum fire position and fully opening the second air aperture in the maximum fire position, the slidable plate partially opening the primary air aperture in the minimum fire position and closing the primary air aperture at a selected position of translation between the minimum fire position and the maximum fire position.

6. The air valve of claim 5 further including a characterized secondary air aperture being shaped to supplement the at least one secondary air aperture for a specific application of the gas burner.

7. A gas burner, comprising:

air valve means being operably, fluidly coupled to both a burner cabinet and a blower for controlling the flow of air from the blower to the burner cabinet, the air valve means having a linearly translatable plate disposed in relationship to a plurality of characterized air apertures such that linear translation of the plate acts to affect the opening area of the plurality of characterized air apertures;

gas valve means fluidly coupled to a source of gas for controlling the flow of gas from said source of gas; and actuation means communicatively coupled to the controller and being linearly coupled to the air valve means and the gas valve means for simultaneous linear actuation thereof responsive to commands from the controller.

8. The gas burner of claim 7 further including at least one interlock switch being disposed within the control cabinet and being communicatively coupled to the controller, this at least one interlock switch being made and unmade by linear actuation of the actuator means.

9. The gas burner of claim 8 wherein the actuator means includes a first arm having a longitudinal axis, axial translation of the first arm acting to actuate the air valve means, the gas valve means and the at least one interlock switch.

10. The gas burner of claim 9, the actuator means further including a second arm having a longitudinal axis operably coupled to the first arm in a substantially transverse disposition, a rotatable arm having a bearing disposed thereon, the bearing being in slidable engagement with the second arm whereby rotation of the rotatable arm causes the bearing to axially translate on the second arm, thereby imparting axial linear translation of the first arm.

11. A gas valve for use with a gas burner, the gas burner having a source of primary air and a source of secondary air, the primary air and the secondary air for combustion with a gas metered by the gas valve, comprising:

an orifice disposed in a gas flow passageway between a gas inlet and a gas outlet, the gas flow passageway being in flow communication with the source of primary air proximate the gas outlet for generating a mixture of gas and primary air, the mixture being deliverable to the gas burner for combustion with the secondary air; and a linearly translatable plug disposed in the orifice being translatable within the orifice along a translation axis, having a tapered dimension extending along the translation axis, whereby linear translation of the plug along the translation axis acts to vary the area of the orifice available for the passage of gas therethrough, a cross sectional dimension of the plug taken along the translation axis being non-linearly varied to characterize the gas flow through the orifice as a function of the linear translation of the plug in relation to the orifice.

12. The gas valve of claim 11 wherein the plug has a compound taper of the tapered dimension.

13. The gas valve of claim 11 wherein the amount of taper of the tapered dimension is varied responsive to the need for a selected gas flow.

14. The gas valve of claim 11 wherein the orifice is generally rectangular in shape and the plug has a generally rectangular cross-section taken transverse to the translation axis thereof.

15. The gas burner of claim 11 further including:

a housing having a longitudinal axis and being fluidly coupled at a gas inlet to a source of gas, and having the gas passageway defined therein;

an orifice plate having the orifice defined therein and being disposed in the gas passageway of the housing, between the gas inlet and the fluid outlet;

a fluid inlet fluidly coupled to the gas passageway between the orifice plate and the fluid outlet, the fluid inlet being coupled to a source of fluid for introducing the fluid to the air passageway and mixing the gas flowing therein.

16. The gas burner of claim 15 wherein the translation axis of the translatable plug being disposed generally parallel to the housing longitudinal axis, and further including a bearing being disposed in the housing and slidably supporting an actuator, the actuator being operably coupled to the translatable plug.

17. A burner gun for use with a gas burner, the gas burner operating between a minimum firing rate and a maximum firing rate, comprising:

a nozzle having a gas inlet and a plurality of gas outlets; and base air delivery means complementing a selectively variable primary air source and complementing a selectively variable secondary air source, the base air delivery means delivering a relatively low volume flow of pressurized air for effecting a minimum firing rate that is less than substantially five percent of the maximum firing rate, the base air mixing with the gas discharged from the plurality of nozzle gas outlets proximate a burner plate.

18. The burner gun of claim 17 wherein the nozzle is generally tubular having a longitudinal axis, having a first end fluidly coupled to a source of fluid and the plurality of nozzle gas outlets being disposed proximate a nozzle second end, the nozzle gas outlets being disposed radially with respect to the nozzle longitudinal axis.

19. The burner gun of claim 18 further including a shroud disposed concentric with the nozzle and spaced apart from the nozzle to define a base air passageway between the shroud and the nozzle, the base air passageway being fluidly coupled to the plurality of air outlets.

20. The burner gun of claim 19 further including an air inlet defined in the shroud and fluidly coupled to the base air passageway.

21. An air valve for use with a gas burner, comprising:

a profile plate having at least one secondary air aperture defined therein and a primary air aperture defined therein, the at least one secondary air aperture being operably fluidly coupled to the gas burner for delivery of a flow of secondary air thereto and the primary air aperture being operably fluidly coupled to the gas burner for delivery of a flow of primary air thereto; and a linearly slidable plate disposed with respect to the profile plate such that linear translation thereof acts to vary the area of the primary air aperture and the at least one secondary air aperture.

22. The air valve of claim 21 being linearly translatable between a minimum fire position and a maximum fire position, the slidable plate substantially closing off the at least one secondary air aperture in the minimum fire position and fully opening the second air aperture in the maximum fire position, the slidable plate partially opening the primary air aperture in the minimum fire position and closing the primary air aperture at a selected position of translation between the minimum fire position and the maximum fire position.

23. The air valve of claim 21 further including a base air aperture and a secondary air bore.

24. The air valve of claim 22 further including a characterized secondary air aperture being shaped to supplement the at least one secondary air aperture for a specific application of the gas burner.

25. The air valve of claim 21 further including a restrictor plate variable positionable with respect to the at least one secondary air aperture to selectively vary the area of the at least one secondary air aperture.

26. An actuator for use with a gas burner, the gas burner having a controller, a gas valve, and an air valve, comprising:

a motor, being operably, communicatively coupled to the controller;

a linear actuator arm operably coupled to the motor and being operably coupled to the gas valve and to the air valve, whereby linear translation of the linear actuator arm imparts simultaneous linear actuation to both the gas valve to control a selectively characterized flow of gas and the air valve to independently control a flow of primary air and a flow of secondary air, a flow of base air being unaffected by the linear translation of the linear actuator arm.

27. The actuator of claim 26 wherein the linear actuator arm has a stroke of a selected length, the stroke defining a minimum fire position at a first end of the stroke and defining a maximum fire position at a second end of the stroke.

28. The actuator of claim 27 wherein the length of the stroke of the linear actuator arm is substantially equal to a stroke of the gas valve between a gas valve minimum fire position and a gas valve maximum fire position and the length of the stroke of the linear actuator arm is substantially equal to a stroke of the air valve of the air valve between an air valve minimum fire position and an air valve maximum fire position.

29. The actuator as claimed in claim 27, the controller having a minimum fire interlock switch and a maximum fire interlock switch, further including actuation means fixedly coupled to the linear actuation arm, the actuation means making the minimum fire switch when the linear actuation arm is at the minimum fire position and the actuation means making the maximum fire switch when the actuation arm is in the maximum fire position.

30. The actuator as claimed in claim 26, further including:

a rotatable actuator arm being rotatably coupled to the motor;

a slidable bearing being operably, rotatably coupled to the rotatable actuator arm and having an actuator bore defined therein; and a transverse actuator arm fixedly coupled to the linear actuator arm and disposed substantially transverse thereto, the transverse actuator arm being slidably disposed within the slidable reading actuator bore.

31. The actuator as claimed in claim 26 further including a sleeve, selectively positioned on the linear actuator arm, having an air control arm operably coupled to the air valve and a gas control arm operably coupled to the gas valve, the air control arm and the gas control arm simultaneously imparting linear actuation to the respective air valve and gas valve responsive to translational motion of the linear actuator arm.

32. A method of controlling a gas burner, the gas burner including an air valve being fluidly coupled to a source of air, a gas valve being fluidly coupled to a source of gas, a burner gun being fluidly coupled to both the air valve and the gas valve, and a plurality of interlock switches, comprising the step of;

simultaneously providing linear actuation to the air valve, the gas valve, and the plurality of interlock switches for operation between a minimum fire position and a maximum fire position; and providing a flow of base air from the air valve to an air passageway defined in the burner gun.

33. The method of claim 32 including the additional step of providing a flow of primary air from the air valve to a fluid passageway defined in the gas valve.

34. The method of claim 33 including the additional steps of providing a flow of primary air at a selected flow volume when in the minimum fire position, increasing said flow rate to a selected maximum flow rate at a selected actuation position between the minimum fire position and the maximum fire position, and ceasing said flow rate at a further selected actuation position that is substantially less than the maximum fire position.

35. A gas burner having a controller disposed in a control cabinet, a burner cabinet, an actuator and a blower, the blower being fluidly coupled to the burner cabinet, comprising:

air valve means being operably, fluidly coupled to both the burner cabinet and the blower for controlling the flow of air from the blower to the burner cabinet;

gas valve means fluidly coupled to a source of gas for controlling the flow of gas from said source of gas;

actuation means communicatively coupled to the controller and being linearly coupled to the air valve means and the gas valve means for simultaneous linear actuation thereof responsive to commands from the controller, the actuator means including a first arm having a longitudinal axis, axial translation of the first arm acting to actuate the air valve means, the gas valve means and the at least one interlock switch, and including a second arm having a longitudinal axis operably coupled to the first arm in a substantially transverse disposition, a rotatable arm having a bearing disposed thereon, the bearing being in slidable engagement with the second arm whereby rotation of the rotatable arm causes the bearing to axially translate on the second arm, thereby imparting axial linear translation of the first arm; and at least one interlock switch being disposed within the control cabinet and being communicatively coupled to the controller, the at least one interlock switch being made and unmade by linear actuation of the actuator means.

36. A burner gun for use with a gas burner, comprising:

a nozzle having a fluid inlet and a plurality of fluid outlets, the nozzle being generally tubular having a longitudinal axis, having a first end fluidly coupled to a source of fluid and the plurality of nozzle outlets being disposed proximate a nozzle second end, the nozzle outlets being disposed radially with respect to the nozzle longitudinal axis;

base air delivery means having an air inlet and a plurality of air outlets, each one with said plurality of air outlets being disposed in a cooperative relationship with a corresponding one of said plurality of nozzle fluid outlets whereby a flow of air discharged from each of said plurality of air outlets mixes with a flow of fluid discharged from the corresponding one of said plurality of nozzle fluid outlets; and a shroud disposed concentric with the nozzle and spaced apart from the nozzle to define a base air passageway between the shroud and the nozzle, the base air passageway being fluidly coupled to the plurality of air outlets.

37. An actuator for use with a gas burner, the gas burner having a controller, a gas valve, and an air valve, comprising:

a motor, being operably, communicatively coupled to the controller;

a linear actuator arm operably coupled to the motor and being operably coupled to the gas valve and to the air valve, whereby linear translation of the linear actuator arm imparts linear actuation to both the gas valve, the linear actuator arm having a stroke of a selected length, the stroke defining a minimum fire position at a first end of the stroke and defining a maximum fire position at a second end of the stroke;

a rotatable actuator arm being rotatably coupled to the motor;

a slidable bearing being operably, rotatably coupled to the rotatable actuator arm and having an actuator bore defined therein; and a transverse actuator arm fixedly coupled to the linear actuator arm and disposed substantially transverse thereto, the transverse actuator arm being slidably disposed within the actuator bore.

* * * * *